US006662944B2

(12) United States Patent
Hagemann et al.

(10) Patent No.: US 6,662,944 B2
(45) Date of Patent: Dec. 16, 2003

(54) FIREARM CARRYING CASE

(75) Inventors: John Hagemann, Plano, IL (US); Joseph Fiore, Lebanon, PA (US); Thomas Hurt, Elgin, IL (US); Jesse Simpkins, Hinckley, IL (US)

(73) Assignee: Plano Molding Company, Plano, IL (US)

( * ) Notice: Subject to any disclaimer, the term of this patent is extended or adjusted under 35 U.S.C. 154(b) by 33 days.

(21) Appl. No.: 09/993,581

(22) Filed: Nov. 6, 2001

(65) Prior Publication Data

US 2003/0085140 A1 May 8, 2003

(51) Int. Cl.[7] ..... B65D 85/00
(52) U.S. Cl. ..... 206/317; 220/8
(58) Field of Search ..... 206/314, 317, 206/315.11, 521; 190/110; 220/8

(56) References Cited

U.S. PATENT DOCUMENTS 3,744,687 A * 7/1973 Oreck ..... 220/8
5,341,590 A * 8/1994 Hepworth et al. ..... 206/315.11
5,669,495 A * 9/1997 West ..... 206/317
5,678,686 A * 10/1997 Hagemann et al. ..... 206/317

* cited by examiner

*Primary Examiner*—Luan K. Bui
(74) *Attorney, Agent, or Firm*—Vedder, Price, Kaufman & Kammholz, P.C.

(57) ABSTRACT

A firearm carrying case includes a rigid outer housing and a flexible inner shell and pockets defined between the flexible inner shell and the outer housing. The outer housing includes a body having a contoured wall with an engagement portion, a chamber, and an open end. The open end is defined in a first plane. The outer housing also includes an end cap having a contoured wall an engagement portion, a chamber, and an open end. The end cap open end is defined in a second plane such that when the body and end cap are interconnected, an interior cavity is defined. The engagement portions interengage along a line of separation disposed oblique to the longitudinal axis, such that disconnection of the end cap from the body is easier. The flexible inner shell includes a soft wall defining an opening and an interior cavity for receiving the firearm. The inner shell is selectively, cooperatively and slidingly received within the chambers. The firearm may be selectively disposed within the flexible inner shell when the flexible inner shell is disposed within the body and carried independently of the rigid outer housing and in cooperation therewith.

19 Claims, 7 Drawing Sheets

FIREARM CARRYING CASE

FIELD OF THE INVENTION

The invention relates generally to protective firearm carrying cases and more particularly to a dual utility firearm carrying case having a rigid outer housing and a removable flexible inner shell.

BACKGROUND OF THE INVENTION

Conventional firearm carrying cases which are utilized to carry, transport or ship firearms and other items are generally constructed in two different forms. One has rigid housing which has the same structure and function as a conventional suitcase. The other has a soft-walled, deformable shell formed generally around an outline of the firearm. Each case is used for a separate specific purpose. The rigid case is ideal for shipping and long-term storage, while the deformable case is ideal for portable in-field transportation. As a result, a hunter is forced to incur the expense of owning both cases and having to choose one over the other for certain activities when neither may be individually suitable for the activity separately.

The rigid cases are generally formed from a metallic or plastic material having a base and lid connected by an elongated piano hinge. The interior is usually filled with a padding material conforming to the interior dimensions to provide cushioning and for securing the firearm against movement within the case. This style of case provides increased protection at the expense of size and portability. However, there are several other disadvantages. Rigid cases are heavy and non-deformable. As a result, these cases have limited utility, and are best suited for shipping by commercial carrier or long-term storage. These rigid cases are cumbersome to carry in the field, such as when a hunter must backpack or use an all-terrain vehicle ("ATV") through rough or wooded terrain. Further, it is known that the weak piano hinge is subject to damage when improperly handled during the loading, storage or unloading of the cases on either private or commercial carriers. The protective capability of this rigid case is compromised when the hinge is damaged.

Other rigid cases are so-called rear load gun cases that have also long been known. See, e.g., U.S. Pat. Nos. 290,208; 784,901 and 3,744,687. More recently, the rear load rigid cases have grown in popularity along with the popularity of ATVs. Brackets have been specifically designed to attach the rear-load cases to the ATV's. See, e.g., U.S. Pat. Nos. 5,706,990 and 6,021,936. The rigid rear-load cases have the interior surfaces lined with a synthetic fur-like material or other material suitable for cushioning purposes. See, e.g., U.S. Pat. Nos. 3,744,687; Des. 421,179 and Des. 309,675.

The soft-walled cases are well known and commonly formed of a layered composite, for example, a fabric, canvas, leather or leather-like exterior material and a foam or woolen-type of interior. These cases are lightweight and flexible. It is known to configure a case to the general profile (side view) of the firearm. Accordingly, the soft-walled cases may be easily carried by a hunter in the field. The disadvantage of these soft-walled cases is that they do not provide adequate security and protection for the firearm during private or commercial shipping of the shell. Further, for obvious reasons, the soft-walled cases are not suitable for mounting by bracket top an ATV.

As a result of the prior art designs, a hunter may need to use both cases for an activity in the field. This is not only costly, but cumbersome and time consuming. Therefore, a need exists to provide a firearm case system having multiple capabilities.

One prior art dual utility firearm carrying case is described U.S. Pat. No. 5,669,495 issued to West. The case includes a rigid outer housing having a plurality of sidewalls to define an interior storage chamber. In the preferred embodiment, one of the ends of the housing is sealed. An opposite open end is selectively closable by a lid which is pivotally secured to one of the elongated sidewalls of the housing. The latching mechanism is provided for securing the lid in close relationship with respect to the housing. The case also includes an inner housing which is sized to fit snugly within the storage chamber of the rigid outer housing. The inner housing includes an outer cover having upper and lower portions which are integrally formed and selectively joined along their outer edges by a closure fastener which, in the preferred environment, is a waterproof zipper. Fitted within the upper and lower cover portions are a pair of oppositely-oriented article-conforming support elements, which are formed of a closed cell foam material which is lightweight and substantially rigid so that an article contained within formed pockets in each of the supports is supported and secured when stored within the inner housing.

One major disadvantage of the case of the '495 patent is that the inner housing must be completely removed from the rigid housing in order to access the contents. In order to place a firearm or other item within the article-conforming supports formed in the closed cell foam material, the inner housing must be opened in a clamshell fashion. The recess formed in the article-conforming support member is accessible only when the inner case has been entirely removed from the rigid housing and opened to its fullest extent, such that the top and bottom portions of the flexible case are disposed substantially co-planar.

Another disadvantage of the case of the '495 patent is that the inner housing is sized to fit snugly within the storage chamber of the outer rigid housing. This design makes insertion and removal of the inner housing difficult. During removal, the snug fit causes a vacuum to form between the inner housing and the rigid outer housing, tending to pull the inner housing back into the storage chamber. During insertion of the inner housing, the snug fit creates an air pocket which resists further insertion of the inner housing into the storage chamber. The snug-fitting feature is necessary to achieve the desired objective of supporting the firearm in the article-conforming recesses of the inner case, such that the firearm is immovable therein as taught in the '495 patent. The inner case of the '495 patent functions the same as its rigid housing save for the soft sides. As a result, the inner housing still retains all of the disadvantages of other prior art cases.

Yet another disadvantage of the '495 patent, is that when the inner case is sized to fit snugly within the rigid housing, the inner case must have the same configuration as the rigid outer housing. As a result, the case is still bulky and difficult to transport in the field.

Accordingly, a need exists for our improved dual utility cases for carrying firearms which advantageously combines a rigid firearm case with a soft-walled case to provide a wide versatility of usage, namely, ability to remove the firearm from both the rigid case and soft-walled case without prior removal of the soft-walled case from the rigid case, and ability to remove the soft-walled case from the rigid case either with or without the firearm disposed within the soft-walled case.

SUMMARY OF THE INVENTION

In one principal aspect of the present invention, the dual utility firearm carrying case includes a rigid outer housing, a flexible inner shell and pockets defined between the flexible inner shell and the outer housing. The rigid outer housing includes a body and an end cap. The body includes a first contoured wall defining a first engagement portion, a first chamber, and a first open end. The first open end is defined by a free edge of the first contoured wall formed in a first plane. The end cap includes a second contoured wall defining a second engagement portion, a second chamber, and a second open end. The second open end is defined by a free edge of the second contoured wall formed in a second plane, such that when the body and the end cap are interconnected an interior cavity is defined. When the first and second engagement portions are connected a line of separation is cooperatively defined oblique to a longitudinal axis of the case such that the end cap may be easily disconnected from the body. The flexible inner shell includes a soft wall defining an opening and an interior cavity for receiving a firearm. The flexible inner shell is configured to be selectively, cooperatively and glidingly received within the first and second chamber. The firearm may be selectively disposed within the flexible inner shell when the flexible inner shell is disposed within the body and carried independently of the rigid outer housing and in cooperation therewith.

In another aspect of the present invention, the dual utility firearm carrying case includes a rigid outer housing and a flexible inner shell. The outer housing includes a body and an end cap. The body includes a first contoured wall defining a first chamber and a first open end. The end cap includes a second contoured wall defining a second chamber and a second open end. The body and the end cap are interconnected to define an interior cavity. The flexible inner case includes a soft wall defining an opening having a closure fastener and an interior cavity for receiving a firearm. The inner case is complementarily configured to be selectively, cooperatively and slidingly received within the cavity and disposed partially within the first chamber and partially within the second chamber, such that removal of the end cap exposes the closure fastener. The firearm may be inserted and removed from the inner case while the inner case is disposed within the rigid outer housing. The firearm may be carried by selective disposition within the flexible inner shell independently of the rigid housing and in cooperation therewith.

Prior firearm cases are bulky, cumbersome and/or unprotective. They are not suitable for common carrier transportation and use by a hunter in the field. For example, conventional firearm cases are suitable for securely transporting, but are bulky and problematic in the field. Further, prior dual utility cases are difficult to separate and reassemble, and remain cumbersome when separated. Consequently, there exists a need for an improved firearm carrying case.

Shilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION OF A PREFERRED EMBODIMENT OF THE INVENTION

Figure 1:
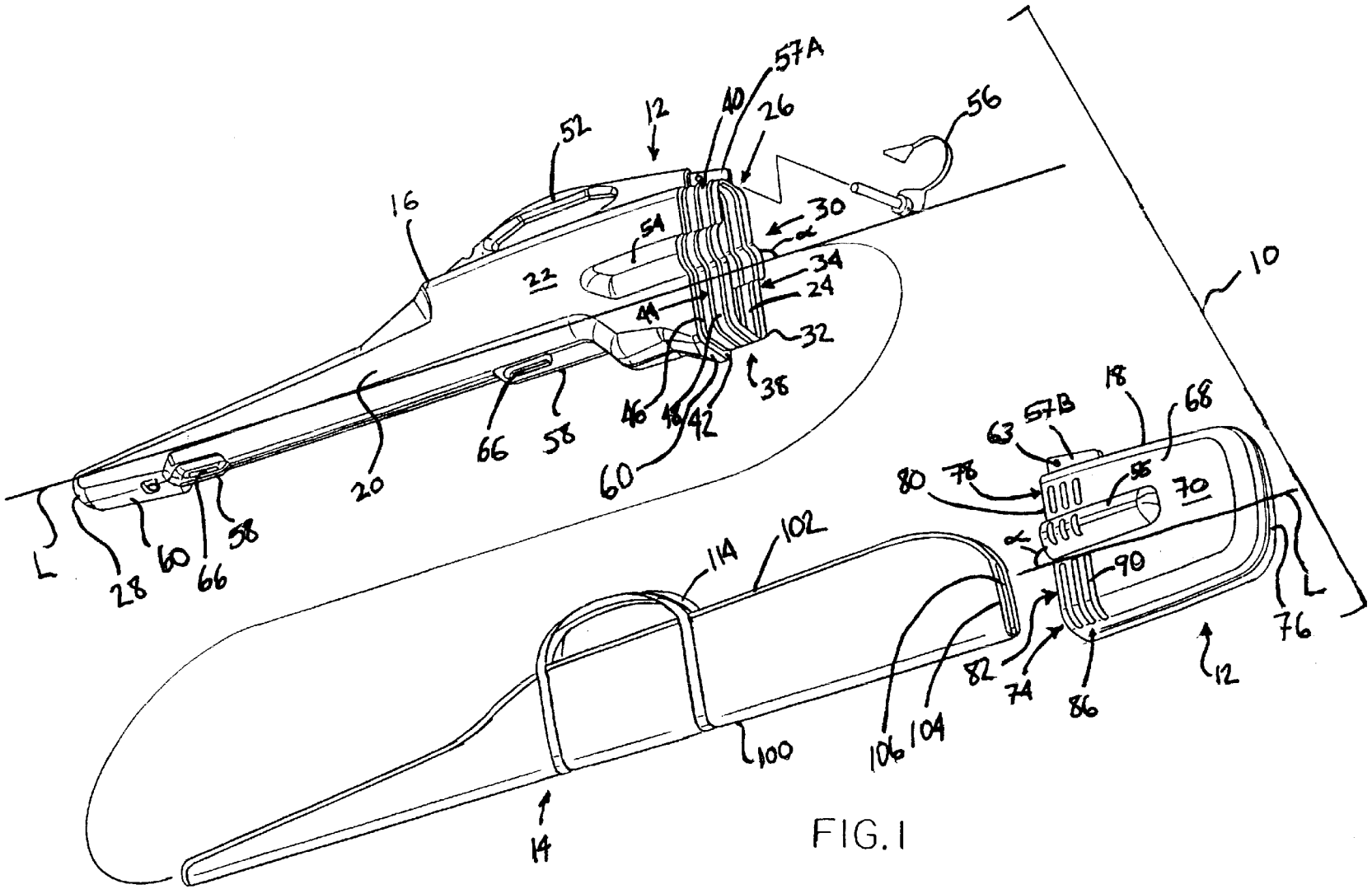
FIG. 1 is an exploded view of a firearm carrying case in accordance with an embodiment of the present invention.
Figure 5:
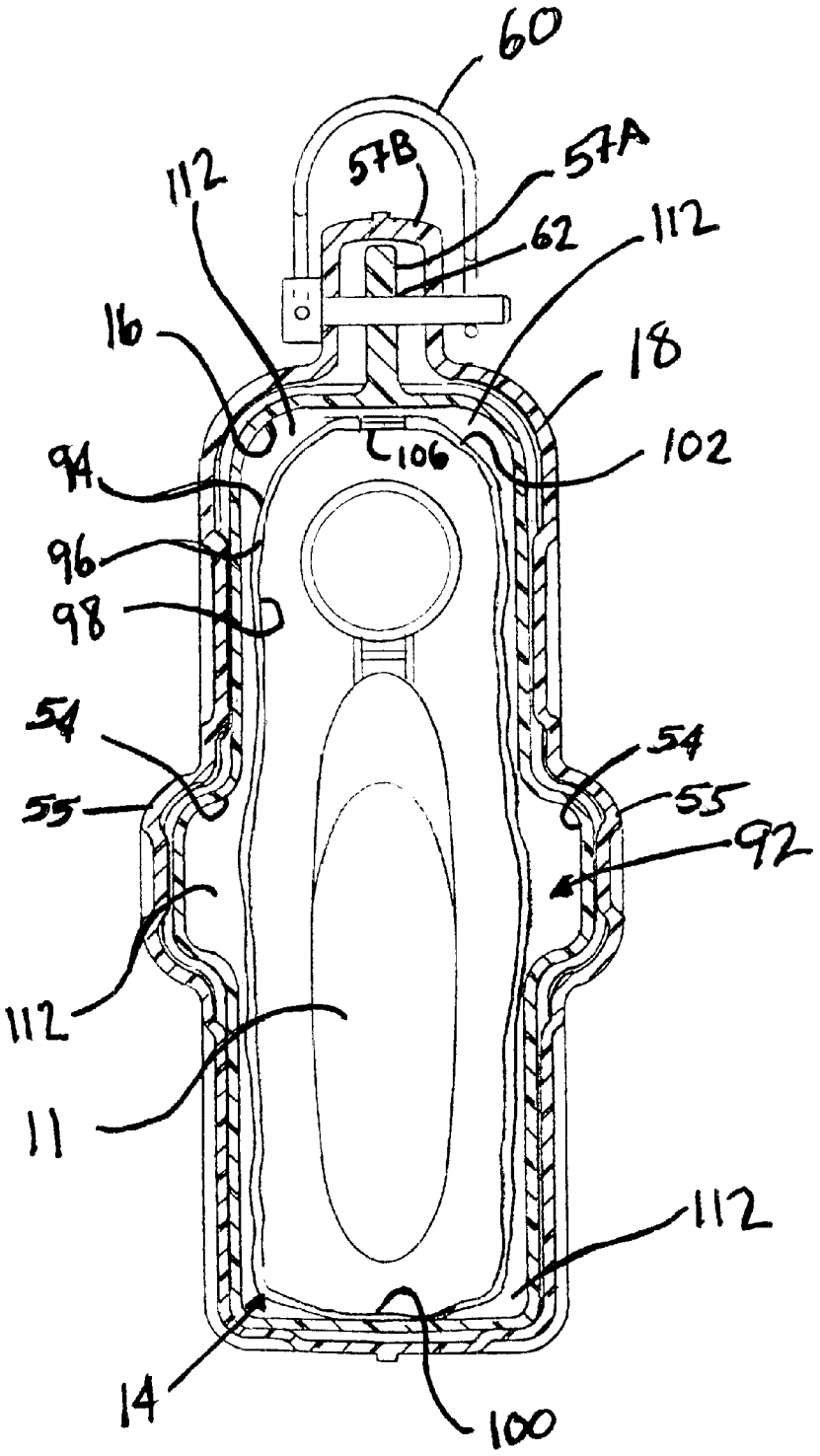
FIG. 5 is a cross-sectional view of the firearm carrying case of the present invention depicted in FIG. 4 taken along line 5—5.
Figure 7:
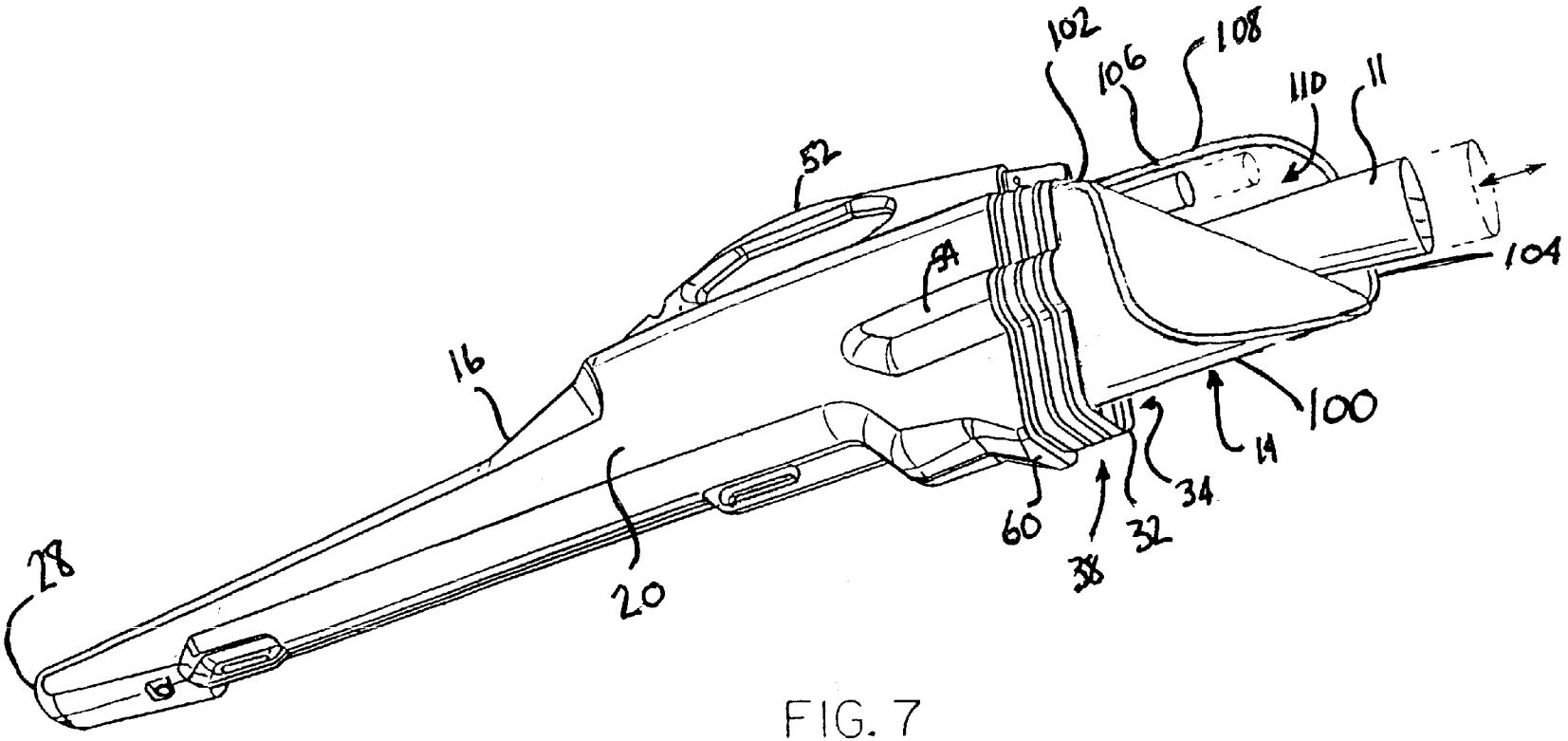
FIG. 7 depicts the inner shell opened while remaining disposed within the outer housing for removal or insertion of the firearm in the direction of the arrow.

With reference to the drawings a dual utility firearm carrying case 10 incorporating the principles of the present invention is shown in FIG. 1. The case includes an outer housing 12 and an interiorly disposed flexible inner shell 14. The case 10 facilitates the safe and convenient transportation and/or storage of a long firearm 11 (FIGS. 5 and 7). It will be recognized that the dimensions of this case may be adjusted as per the dimension or configuration of the firearm. For example, the case may be configured for a long firearm, a pistol or any other suitable configuration. Preferably, the case 10 provides protection not only during transportation in a private or commercial carrier such as an auto, truck, train or airplane, but also when attached via a bracket to ATV. Use of the case in this manner, permits maximum protection for the firearm deep into the woods. When the ATV cannot proceed any further, the flexible inner shell housing the firearm may be removed from the outer housing 12 in order to proceed deeper into the woods with a certain amount of protection for the firearm.

Figure 2:
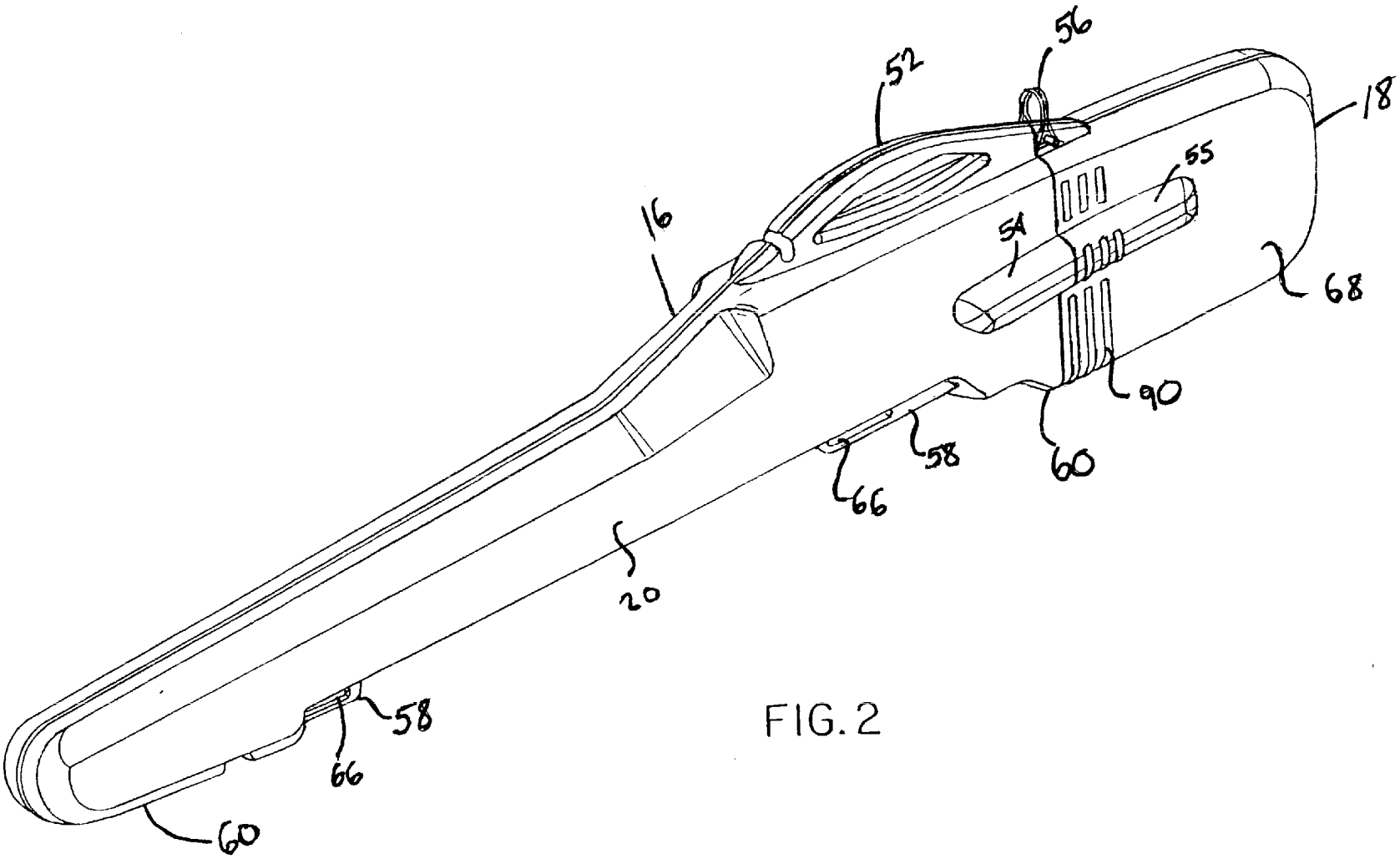
FIG. 2 is a top perspective view of the firearm carrying case of the invention.
Figure 3:
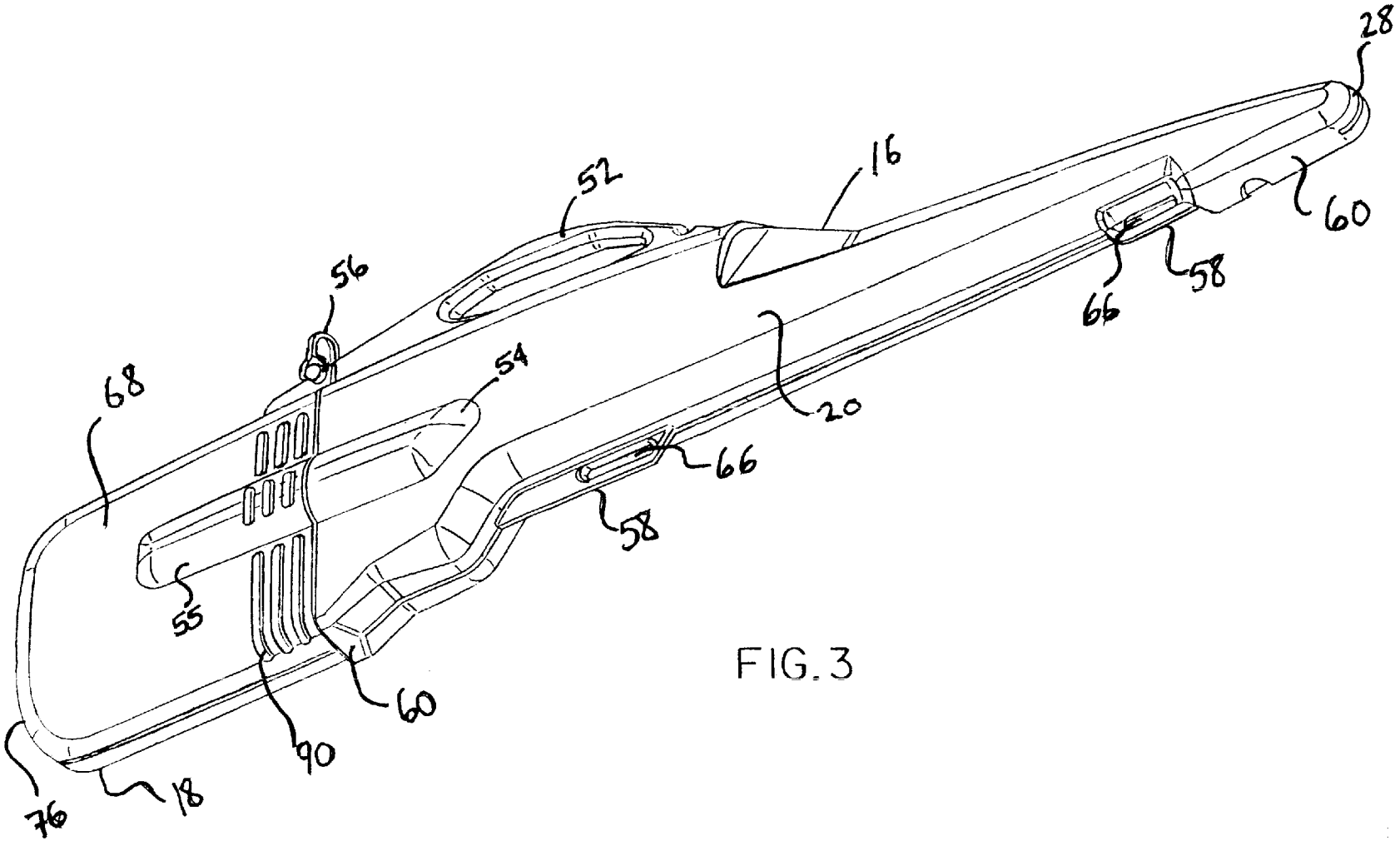
FIG. 3 is a bottom perspective view of the firearm carrying case of the present invention.
Figure 4:
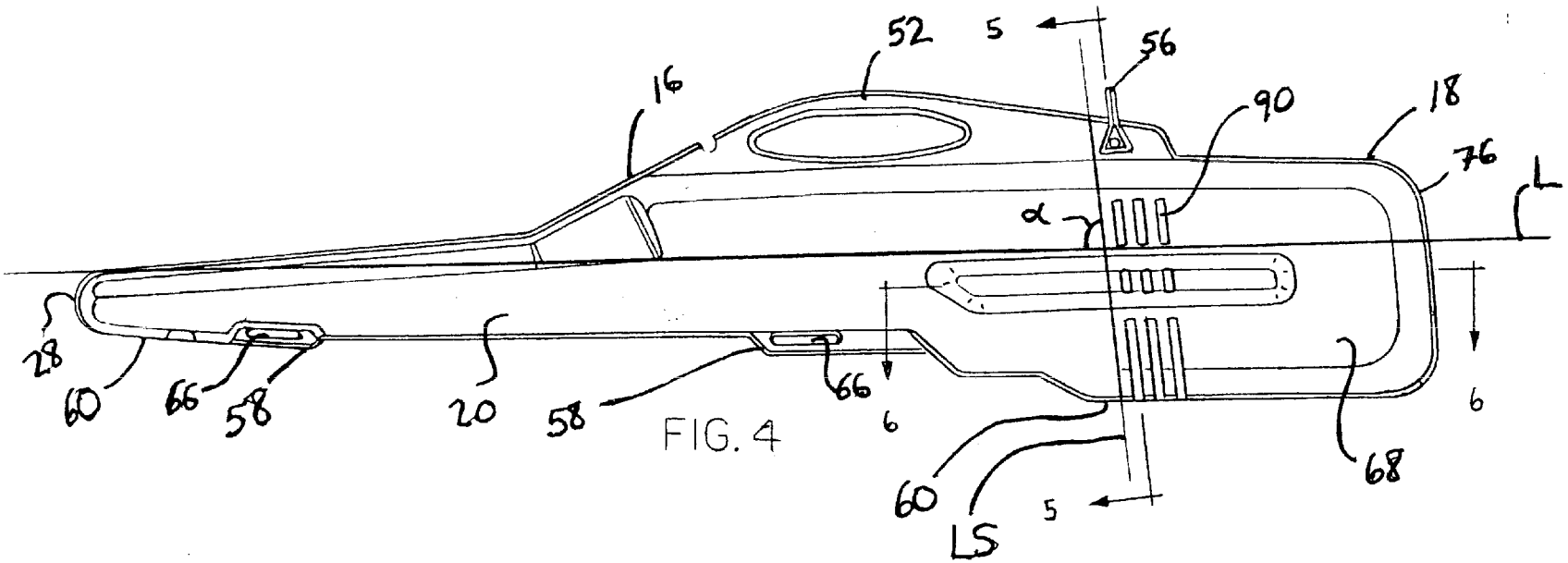
FIG. 4 is a side elevation view of the firearm carrying case of the present invention.

As shown in FIGS. 1–3, the outer housing 12 includes a main body portion 16 and an end cap 18. Preferably the outer housing 12 is formed of a suitable plastic material. For example, the outer housing 12 may be preferably formed from different plastics such a acryloritrile butadiene styrene, polypropylene, polyethylene or any other suitable material. The body portion 16 and end cap 18 are preferably formed in any suitable process. For example, the body portion 16 and end cap 18 may be formed by a suitable manufacturing process, such as a blow molding, injection molding, thermo molding, thermo forming, rotational molding, rotational forming or any other suitable process. This body portion 16 includes a first contoured wall 20 defining a first engagement portion 38, a first chamber 30 and a first open end 26. The first contoured wall 20 has a predetermined thickness with an outer surface 22 and an inner surface 24. It will be recognized that the predetermined thickness of the wall 20 is suitable to provide protection against impact and abrasion forces. For example, the predetermined thickness in this embodiment may be preferably 0.120"–0.170" and may range from 0.80"–0.200" or any other suitable dimension. The outer surface 22 may have a generally rough texture for an improved grasping surface or any other suitable surface texture. The first contoured wall 20 in this embodiment generally follows an outline of the long firearm which has a larger dimension at the first open end 26 of the longitudinal axis L and has a smaller dimension at a first closed end 28 of the longitudinal axis L.

The first open end 26 is defined by a free edge 32 of the first contoured wall 20. The free edge 32 is formed in a first plane which is disposed oblique to the longitudinal axis L in this embodiment as depicted by angle α. It will be recognized that the first plane may be disposed at any suitable angle to achieve the following advantages. The free edge 32 defines one opening 34 for the first chamber 30.

Figure 6:
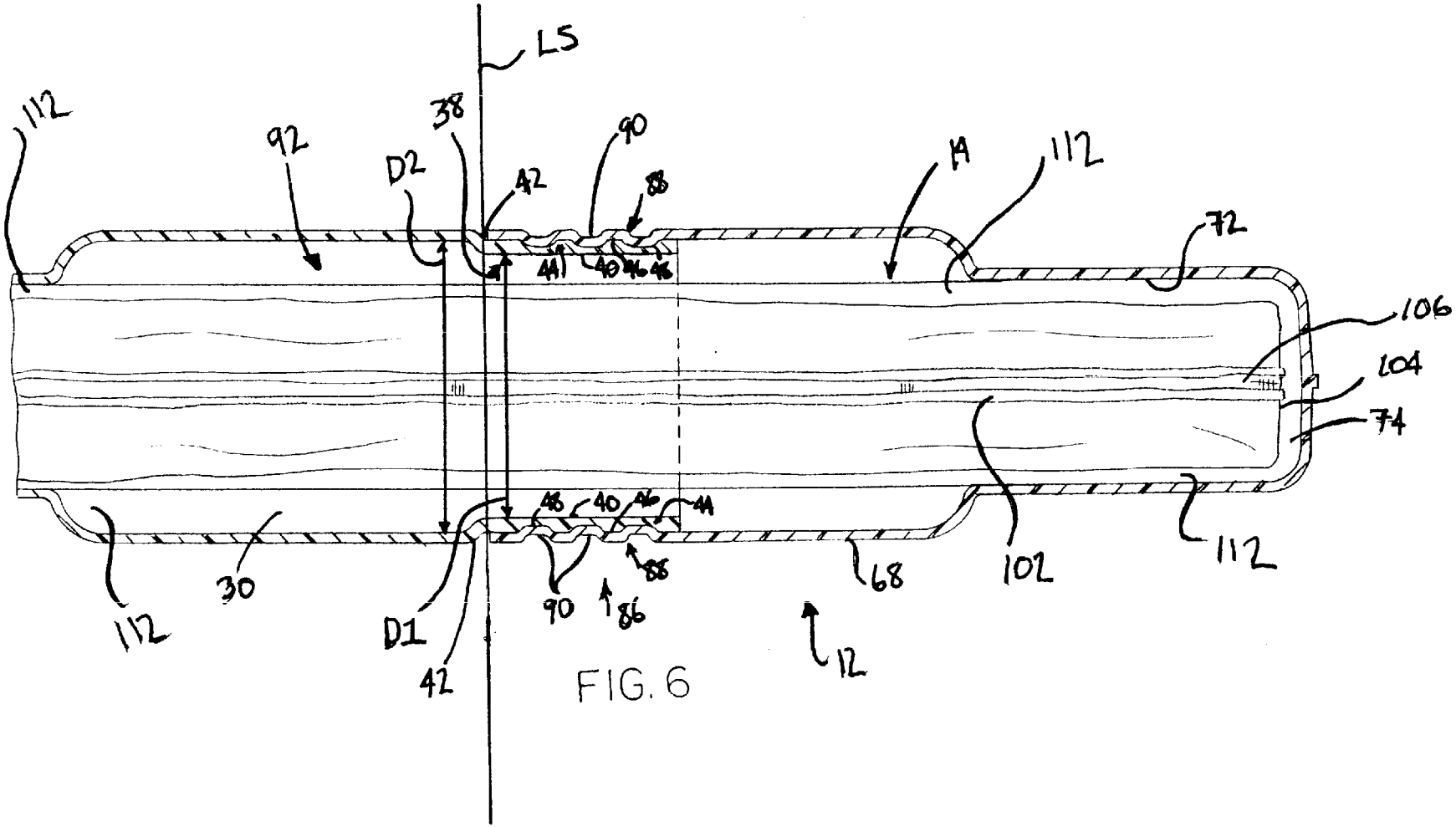
FIG. 6 is a broken away partial cross-sectional view of the firearm carrying case of the present invention depicted in FIG. 4 taken along line 6—6.

The first engagement portion 38 is formed in the first contoured wall 20 adjacent the first open end 26 for engaging the end cap 18. In this embodiment, the first engagement portion 38 is formed at the first open end 26 as an offset sleeve 40 separated from the remainder of the main body portion 16 by a shoulder 42 (see also FIG. 6). As shown in FIG. 6, a width dimension D1 of the sleeve 40 is less than a width dimension D2 of the main body portion 16 adjacent the shoulder 42. A plurality of first interconnection elements 44 are formed in the first engagement portion 38 for retaining the end cap 18 attached to the main body portion 16. In this embodiment, the first interconnection elements 44 are formed as alternating ribs 46 and channels 48 with at least one rib 46 and channel 48. It will be recognized that the alternating ribs 46 and channels 48 may be formed with any suitable number. For example, there may be an odd number of interconnection elements in total or individually, or any other suitable configuration. As shown in FIG. 7, the ribs 46 in this embodiment extend substantially continuously about the circumference of the sleeve 40. However, it will be recognized that the ribs 46 may be formed in any suitable configuration. For example, the ribs may be segmented along their length around the sleeve 40 or any other suitable configuration.

As shown in FIGS. 1–4, the end cap 18 includes a second contoured wall 68 defining a second engagement portion 86, a second chamber 74, and a second open end 78. The second contoured wall 68 has a predetermined thickness with an outer surface 70 and an inner surface 72 (FIG. 6). It will be recognized that the predetermined thickness of the wall 68 is suitable to provide protection against impact and abrasion forces. For example, the predetermined thickness in this embodiment may be preferably 0.120"–0.170" and may range from 0.080"–0.200" or any other suitable dimension. The outer surface 70 may have a generally rough texture for an improved grasping surface or any other suitable surface texture. The second contoured wall 68 includes a second open end 78 and a second closed end 76 defining a second chamber 74 therein. The second open end 78 is defined by a second free edge 80 of the second contoured wall 68 which defines an opening 82 for the second chamber 74. The second free edge 80 is formed in a second plane which is preferably disposed oblique to the longitudinal axis L and substantially parallel to the first plane 36, as depicted by angle α.

As shown in FIG. 6, a second engagement portion 86 is formed in the second contoured wall 68 at the second open end for complementary engagement with the first engagement portion 38. In this embodiment, the second engagement portion 86 is defined in an annular area, coplanar with the remainder of the second contoured wall 68. A plurality of second interconnection elements 88 are formed in the second engagement portion 86 to engage the first interconnection elements 44 of the main body 16 such that the main body 16 and end cap 18 are retained in an interconnection configuration. In this embodiment, the second interconnection elements 88 include a series of spaced projections 90 which extend form the inner surface 72 toward oppositely disposed second interconnection elements 88. It will be recognized that projections 90 may be formed in any suitable configuration. For example, there may be at least one projection, an odd number of projections or any other suitable configuration. As shown in FIGS. 1–4, the projections 90 are segmented about the circumference of the second end 78. However, it will be recognized that the projections 90 may be formed continuously about the end cap 18 if so desired. The number and type of projections 90 and ribs 46 may be varied in accordance with the desired retention force.

In this embodiment, as shown in FIGS. 1–3 and 5, alignment contours 54 are formed on opposing sides of the main body portion 16 extending from the first end 26 for a desired extent. It will be recognized that the alignment contours 54 may have any suitable configuration. For example, the alignment contours 54 may be formed as a rounded shape, having a number of specific sides and edges or any other suitable configuration. Alignment receptacles 55 are formed on the end cap 18 complementary to the alignment contours 54 for operative connection therebetween. The at least one alignment contour 54 and alignment receptacle 55 are disposed on the case 10 such that the main body 16 and end cap 18 may interengage unidirectionally.

As shown in FIGS. 5 and 6, an interior cavity 92 is defined by the cooperative association of the main body 16 and the end cap 18. A line of separation LS (FIGS. 4 and 6) is defined by the second free edge 80 and the shoulder 42 which is oblique to the longitudinal axis L in this embodiment. As a result of the oblique orientation, the end cap 18 is easily disconnected from the main body 16. Further, as shown in FIG. 6, it will be recognized that the first contoured wall and the second contoured wall are substantially coplanar about the line of separation.

The flexible inner shell 14, as shown in FIGS. 1 and 5–7, is configured to be received within the interior cavity 92 defined by the first chamber 30 and the second chamber 74 when the main body 16 and end cap 18 are cooperatively associated (FIG. 6). The inner shell 14 includes a soft wall and, in this embodiment, is formed from any suitable material or combination of materials. For example, a heavy duty fabric or natural material, such as leather or other suitable material may form an outer covering 94 of the inner shell 14, and a layer of foam 96 or other suitable material may be disposed on the interior surface of the outer covering 94 to provide impact resistance. The foam layer 96 may be either an open-celled or closed-celled foam or any other suitable material. An inner cover 98 is disposed on the opposite surface of the foam layer 96 which may be formed from any suitable material which is soft and will not damage the surfaces of the firearm.

The inner shell 14 in this embodiment, FIGS. 1 and 5–7, is formed as a unitary element which is folded in half along a fold line defining a bottom edge 100 of the inner shell 14. It will be recognized that the inner shell 14 may be formed in any other suitable configuration. For example, the inner shell 14 may formed of several separate pieces connected together, or any other suitable configuration. The inner shell 14 defines an opening 108 and a shell interior cavity 110 for receiving the firearm 11. A closure fastener 106 is associated with the opening 108 and is preferably disposed on a back edge 104 and a portion of a top edge 102. The remainder of the top edge 102 is joined together along the remaining length in a conventional manner such as sewing, adhesive or fusing. The inner shell 14 is configured to be selectively, cooperatively and slidingly received and disposed within the interior cavity 92. Pockets 112 are defined between the inner shell 14 and the outer housing 12 when the inner shell 14 is disposed within the outer housing 12 so that the inner shell 14 may be easily inserted and removed. It will be recognized that the loose fitting inner shell 14 is advantageous in that the hunter does not have to overcome the pressure within the case created by insertion of a snug form-fitting inner element nor the vacuum created by removing such a snug form fitting inner element. A pair of handles 114 (FIG. 1) are also attached to the inner shell 14 for transportation purposes.

As shown in FIGS. 1–5, the firearm carrying case 10 also includes a handle 52, lock mechanism 56, sling mounts 58, and balance pads 60. The handle 52 is integrally formed on the top of the main body portion 16 near the center of gravity of the case when loaded with the firearm. The lock mechanism 56 includes a rib 57A formed as an extension of the handle 52 adjacent the first open end 26, and a housing 57B formed on the end cap 18. A first aperture 62 is formed in the rib 57A and a second aperture 63 is formed in each side of the housing 57B such that when the main body 16 and end cap 18 are interconnected all of the apertures 62, 63 are in registry. In this embodiment, a locking element in the form of a hasp latch 62 may be inserted through the apertures 62, 63 to securing the end cap 18 to the main body 16. It will be recognized that any other suitable locking element may be used. For example, a padlock or any other suitable locking element. The sling mounts 58 formed on the bottom of the main body 16 have longitudinally extending apertures 66. A sling (not shown) may be attached in a suitable manner so that the case 10 may be carried. The balance pads 60 are formed on the bottom of the main body 16 at the second end 28 and adjacent the shoulder 42 near the first open end 26. The sling mounts 58 are disposed between the balance pads 60. The balance pads 60 provide stability for the case 10 when it is disposed in an upright orientation on a surface.

In operation, as partially shown in FIG. 7, the firearm 11 may be selectively disposed with the shell interior cavity 110 of the flexible inner shell 14 when the inner shell 14 is disposed within the body 16. The closure fastener 106 may then be closed. If the inner shell 14 is not disposed within the body 16, the end cap 18 may be removed from the body 16 by rotating the end cap 18 in a direction away from the handle 52. The flexible inner shell 14 may then be slidingly received within the first chamber 30 of the body 16. A portion of the inner shell 14 remains disposed outside the first chamber 30 so that the closure fastener 106 may be moved to an open position in order to remove the firearm 11 while the inner case 14 remains disposed within the first chamber 30. Transportation of the firearm may be independent of the outer housing 12 or in cooperation therewith. If transportation within the outer housing 12 is desired, the end cap 18 is aligned with the main body 16 such that the portion of the inner case 14 disposed outside the first chamber 30 is received within the second chamber 74 of the end cap 18. The end cap 18 is then fully installed such that the first and second interconnection elements 44, 88 engage and the second free edge 80 is disposed adjacent to the shoulder 42. The flexible inner shell 14 is then securely disposed within the interior cavity 92. The lock mechanism 56 may then be attached. When the hunter is in the field, the lock mechanism 56 in the end cap 18 are removed and the user may then remove the flexible inner shell 14 for independent transportation of the firearm.

Furthermore, while the particular preferred embodiments of the present invention have been shown and described, it will be obvious to those skilled in the art that changes and modifications may be made without departing from the teaching of the invention. The matter set forth in the foregoing description and accompanying drawings is offered by way of illustration only and not as limitation. The actual scope of the invention is intended to be defined in the following claims when viewed in their proper perspective based on the prior art.

What is claimed is:

1. A dual utility firearm carrying case, comprising:

a rigid outer housing, a flexible inner shell and pockets defined between the flexible inner shell and the outer housing;

the outer housing including a body and an end cap;

the body including a first contoured wall defining a first engagement portion, a first chamber, and a first open end;

the first open end defined by a free edge of the first contoured wall formed in a first plane;

the end cap including a second contoured wall defining a second engagement portion, a second chamber, and a second open end;

the second open end defined by a free edge of the second contoured wall formed in a second plane;

an interior cavity defined by cooperative association of the body and end cap; and the flexible inner shell including a soft wall defining an opening and a shell interior cavity for receiving a firearm, such that said flexible inner shell is configured to be selectively, cooperatively and slidingly received within the first chamber and the second chamber, whereby the firearm may be inserted within and removed from the flexible inner shell when the flexible inner shell is disposed within the body.

2. The case as recited in claim 1, wherein the first engagement portion is disposed adjacent said first open end and is formed as a recessed sleeve separated from the body by a shoulder.

3. The case as recited in claim 1, wherein the first engagement portion further includes at least two longitudinally spaced interconnection elements.

4. The case as recited in claim 1, wherein the first engagement portion further includes an odd number of interconnection elements.

5. The case as recited in claim 1, wherein the second engagement portion further includes at least one interconnection element.

6. The case as recited in claim 1, wherein the first contoured wall and the second contoured wall are substantially coplanar about a line of separation.

7. The case as recited in claim 1, wherein the body includes at least one alignment contour and the end cap includes an alignment receptacle for operative connection such that the body and the end cap interconnect unidirectionally.

8. The case as recited in claim 1, wherein the housing further includes a lock mechanism, a handle, and sling mounts.

9. The case as recited in claim 1, wherein the inner shell opening further includes a closure fastener for closing the opening so that the firearm is secured within the cavity.

10. A dual utility firearm carrying case, comprising:

a rigid outer housing and flexible inner shell;

the outer housing including a body and an end cap;

the body including a first contoured wall defining a first chamber and a first open end;

the end cap including a second contoured wall defining a second chamber and a second open end;

the body and end cap interconnected to define an interior cavity;

the flexible inner shell including a soft wall defining an opening, an interior cavity for receiving a firearm and having a closure fastener associated with the opening, such that the inner shell is complementarily configured to be selectively, cooperatively and slidingly received within the cavity disposed partially within the first chamber and partially within the second chamber such that removal of the end cap exposes a portion of the inner shell extending from the body such that the closure fastener associated with the portion of the inner shell may be moved so that the firearm may be inserted and removed from the inner shell while the inner shell is disposed within the body.

11. The case as recited in claim 10, wherein the body and end cap further include respective first and second engagement portions disposed adjacent respective said first and second open ends.

12. The case as recited in claim 11, wherein the first engagement portion further includes at least two longitudinally spaced interconnection elements.

13. The case as recited in claim 11, wherein the second engagement portion further includes at least one interconnection element.

14. The case as recited in claim 11, wherein the first and second engagement portions each include an odd number of interconnection elements.

15. The case as recited in claim 11, wherein the first open end is defined by a first free edge of the first contoured wall formed in a first plane obliquely disposed to a longitudinal axis of the case, and the second open end is defined by a second free edge of the second contoured wall formed in a second plane parallel to the first plane, such that interconnection of the body and end cap defines a line of separation obliquely disposed to the longitudinal axis adjacent the second open end.

16. The case as recited in claim 15, wherein the first engagement portion is disposed adjacent the first open end and formed as a recessed sleeve separated from the body by a shoulder, such that the line of separation is defined by a shoulder and the second free edge.

17. The case as recited in claim 16, wherein the contoured body wall and contoured end cap wall are substantially coplanar adjacent the line of separation.

18. The case as recited in claim 10, wherein the inner shell includes a bottom edge, a top edge and a back edge, such that the opening is continuously formed along a first extent of the back edge and along a second extent of the top edge, and the closure fastener is associated with the opening.

19. A dual utility firearm carrying case, comprising:

a rigid, outer housing and a flexible inner shell;

the outer housing including a body and an end cap;

the body including a first contoured wall having a generally tapered configuration from a first dimension at a first end to a second dimension at a second end, defining a first chamber open at the first end and closed at the second end, and an alignment contour disposed in at least one side wall disposed adjacent the first end;

the first end including a free end which lies in a first plane obliquely disposed to a longitudinal axis of the case, and a first engagement portion defined in a recessed sleeve offset from the body at a shoulder having at least two longitudinally spaced interconnection elements;

the end cap including a second contoured wall having a generally uniform dimension configuration, including a second engagement portion and defining a second chamber closed at a first end and open at a second end;

a free end of said second contoured wall lying in a second plane complementary to the first plane, and a second engagement portion defined adjacent the free end having at least one interconnection element, such that body and the end cap interconnect to define a line of separation obliquely disposed to the longitudinal axis of the case;

the flexible inner shell including a bottom edge, a top edge, a back edge defining an interior cavity and an opening with an associated closure fastener so that a firearm may be selectively, cooperatively and slidingly received within the first chamber and the second chamber when the body and end cap are interconnected, and within the first chamber when the end cap is removed such that said closure fastener is entirely accessible to remove or insert the firearm from the inner shell while the inner shell remains partially disposed within the first chamber, whereby the firearm may be carried by selective disposition within the flexible inner shell independently of the rigid outer housing and in cooperation therewith.

* * * * *